US011518487B1

(12) United States Patent
Pelin et al.

(10) Patent No.: US 11,518,487 B1
(45) Date of Patent: Dec. 6, 2022

(54) WATERCRAFT, MOTOR POD, AND ASSOCIATED METHODS

(71) Applicants: Per Pelin, Torslanda (SE); Paul Donald Salmon, Mankato, MN (US); Jay Thomas Erwin, Fort Ripley, MN (US); Ronald Phillip Hansen, Mapleton, MN (US)

(72) Inventors: Per Pelin, Torslanda (SE); Paul Donald Salmon, Mankato, MN (US); Jay Thomas Erwin, Fort Ripley, MN (US); Ronald Phillip Hansen, Mapleton, MN (US)

(73) Assignee: Johnson Outdoors Inc., Racine, WI (US)

( * ) Notice: Subject to any disclaimer, the term of this patent is extended or adjusted under 35 U.S.C. 154(b) by 63 days.

(21) Appl. No.: 17/028,409

(22) Filed: Sep. 22, 2020

Related U.S. Application Data

(60) Provisional application No. 62/933,775, filed on Nov. 11, 2019.

(51) Int. Cl.

| | |
|---|---|
| ***B63H 25/42*** | (2006.01) |
| ***B63H 25/04*** | (2006.01) |
| ***B63H 20/00*** | (2006.01) |

(52) U.S. Cl.
CPC ..... *B63H 25/42* (2013.01); *B63H 20/007* (2013.01); *B63H 25/04* (2013.01); *B63H 2020/003* (2013.01)

(58) Field of Classification Search
CPC ..... B63H 25/42; B63H 20/007; B63H 25/04; B63H 2020/003
See application file for complete search history.

(56) References Cited

U.S. PATENT DOCUMENTS

| | | | |
|---|---|---|---|
| 3,176,645 | A | 4/1965 | Shatto, Jr. |
| 4,406,630 | A | 9/1983 | Wood, Jr. |
| 5,041,029 | A | 8/1991 | Kulpa |
| 5,362,263 | A | 11/1994 | Petty |
| 5,386,368 | A | 1/1995 | Knight |
| 5,491,636 | A | 2/1996 | Robertson et al. |
| 5,525,081 | A | 7/1996 | Mardesich et al. |
| 5,662,505 | A | 9/1997 | Spriggs |
| 5,884,213 | A | 3/1999 | Carlson |
| 6,254,441 | B1 | 7/2001 | Knight et al. |
| 6,276,975 | B1 | 8/2001 | Knight et al. |
| 6,299,493 | B1 | 10/2001 | Griffith, Sr. et al. |
| 6,322,406 | B1 | 11/2001 | Griffith, Sr. et al. |
| 6,325,685 | B1 | 12/2001 | Knight et al. |
| 6,350,164 | B1 | 2/2002 | Griffith, Sr. et al. |
| 6,361,385 | B1 | 3/2002 | Bland et al. |
| D455,437 | S | 4/2002 | Knight et al. |
| 6,363,875 | B1 | 4/2002 | Griffith, Sr. et al. |
| 6,369,542 | B1 | 4/2002 | Knight |
| 6,394,859 | B1 | 5/2002 | Knight et al. |

(Continued)

OTHER PUBLICATIONS

U.S. Appl. No. 60/138,890, filed Jun. 11, 1999, Bernloehr et al.

*Primary Examiner* — Anthony D Wiest
(74) *Attorney, Agent, or Firm* — Reinhart Boerner Van Deuren P.C.

(57) ABSTRACT

A watercraft, associated motor pod, and associated methods are provided. The motor pod is operable to maintain an orientation of the watercraft relative to a reference datum while the watercraft is moving or stationary.

17 Claims, 5 Drawing Sheets

(56) References Cited

U.S. PATENT DOCUMENTS

| | | | |
|---|---|---|---|
| 6,416,368 | B1 | 7/2002 | Griffith, Sr. et al. |
| D461,480 | S | 8/2002 | Knight et al. |
| D461,824 | S | 8/2002 | Knight et al. |
| D461,825 | S | 8/2002 | Hansen |
| D462,078 | S | 8/2002 | Hansen |
| 6,431,923 | B1 | 8/2002 | Knight et al. |
| 6,579,133 | B1 | 6/2003 | Harris |
| 6,678,589 | B2 | 1/2004 | Robertson et al. |
| 6,802,749 | B1 | 10/2004 | Justus |
| 6,848,382 | B1 | 2/2005 | Bekker |
| 7,538,511 | B2 | 5/2009 | Samek |
| 8,082,100 | B2 | 12/2011 | Grace et al. |
| 8,510,028 | B2 | 8/2013 | Grace et al. |
| 8,515,660 | B2 | 8/2013 | Grace et al. |
| 8,515,661 | B2 | 8/2013 | Grace et al. |
| 8,527,192 | B2 | 9/2013 | Grace et al. |
| 8,543,324 | B2 | 9/2013 | Grace et al. |
| 8,831,868 | B2 | 9/2014 | Grace et al. |
| 9,067,664 | B2 | 6/2015 | Yuet et al. |
| 9,162,743 | B1 | 10/2015 | Grace et al. |
| 9,266,589 | B2 | 2/2016 | Grace et al. |
| 9,394,040 | B2 | 7/2016 | Grace et al. |
| 9,446,831 | B2 | 9/2016 | Grace et al. |
| 9,463,860 | B2 | 10/2016 | Grace et al. |
| 9,505,477 | B2 | 11/2016 | Grace et al. |
| 9,522,721 | B2 | 12/2016 | Grace et al. |
| 9,708,042 | B2 | 7/2017 | Grace et al. |
| 9,738,364 | B2 | 8/2017 | Abney |
| 9,758,222 | B2 | 9/2017 | Grace et al. |
| 9,944,365 | B2 | 4/2018 | Grace et al. |
| 10,025,312 | B2 | 7/2018 | Langford-Wood |
| 10,322,780 | B2 | 6/2019 | Grace et al. |
| 10,507,895 | B2 | 12/2019 | Grace et al. |
| 10,739,771 | B2 | 8/2020 | Miller et al. |
| 11,181,915 | B2 * | 11/2021 | Vanhakartano ..... B63H 21/21 |
| 2017/0101167 | A1 | 4/2017 | Howard et al. |
| 2018/0297674 | A1 | 10/2018 | Grace et al. |
| 2020/0333786 | A1 | 10/2020 | Miller et al. |

* cited by examiner

WATERCRAFT, MOTOR POD, AND ASSOCIATED METHODS

CROSS-REFERENCE TO RELATED PATENT APPLICATIONS

This patent application claims the benefit of U.S. Provisional Patent Application No. 62/933,775, filed Nov. 11, 2019, the entire teachings and disclosure of which are incorporated herein by reference thereto.

FIELD OF THE INVENTION

This invention generally relates to watercrafts, and more particularly to devices used for operating the watercraft, and even more particularly to motors associated with a watercraft for providing directional thrust.

BACKGROUND OF THE INVENTION

Watercrafts are often equipped with a trolling motor for providing a relatively small amount of thrust to slowly and quietly propel the same. They advantageously provide for a finer adjustment of watercraft position than a main motor outboard motor. Given this functionality trolling motors remain a viable and sought after apparatus for various applications, including but not limited to fishing, recreation, and commercial applications. Further, given their relatively low weight, size, and power supply needs, such trolling motors may be readily incorporated into a variety of styles of watercraft, e.g. fishing boats, kayaks, etc.

In the context of fishing boats, for example, trolling motors are often mounted to the bow. A main outboard motor is also typically mounted to the transom. The main outboard motor is used for macro movement of the boat, such as for traversing longer distances, while the trolling motor is used for finer positioning of the boat. While the capabilities of such a dual motor setup are vast, a typical use involves using the main outboard to get to a certain area, and then using the trolling motor for finer navigation. For example, an angler on a fishing boat might utilize the trolling motor once in a given location to position the watercraft near a desirable fishing location or navigate a desirable route while fishing.

Contemporary trolling motors employ a variety of desirable features to achieve the above functionality. For example, such trolling motors may include GPS and other navigational features, or they may communicate with an external device that includes such features such as a fish finder or a mobile device. These GPS and other navigational features allow the trolling motor to cause the watercraft to automatically navigate a given route. Indeed, such trolling motors may have the capability to move the watercraft from waypoint to waypoint, follow a depth contour, or serve as a virtual anchor by maintaining the bow of the watercraft within a given zone.

While the above features have become a staple of the modern trolling motor's functionality, there remains opportunities for additional improvements. Indeed, in the typical bow mounted trolling motor configuration described above, the trolling motor is capable of holding the bow of the watercraft in a given location, or navigating the bow of the watercraft along a given route. However, the transom of the watercraft is left to sway freely due to wind and water currents as well as the momentum created by the bow mounted trolling motor itself. In other words, the bow mounted trolling motor is not ideal for maintaining the watercraft in a fixed orientation relative to the water.

The aforementioned sway of the transom make certain activities difficult. For example, where an angler desires to fish from the watercraft near the transom, this sway can cause undesirable repositioning of the angler relative to their cast point. It can also be problematic where an angler desires to fish directly below the boat at a given depth. Additionally, when multiple fishing lines extend away from the watercraft, the aforementioned sway can cause entanglement of these lines.

Accordingly, there is a need in the art for configuration that can hold a watercraft in a fixed orientation relative to the water. The invention provides such a configuration. These and other advantages of the invention, as well as additional inventive features, will be apparent from the description of the invention provided herein.

BRIEF SUMMARY OF THE INVENTION

In one aspect the invention provides a watercraft. An embodiment of such a watercraft includes a hull defining a keel axis, a bow, and a transom of the watercraft. The watercraft also includes a trolling motor mounted proximal to the bow of the watercraft. The watercraft also includes at least one motor pod mounted proximal the transom of the watercraft. The at least one motor pod is arranged to provide thrust in a first direction and a second direction along a thrust axis. The thrust axis is arranged transverse to the keel axis.

In certain embodiments according to this aspect, the thrust axis is perpendicular to the keel axis. The watercraft may also include a control interface for controlling the trolling motor and the at least one motor pod. The control interface may be external to the trolling motor. As one exemplary alternative, the control interface may include an internal controller of the trolling motor. The control interface may also include a multi-function display. The control interface may include a foot pedal. The control interface may include a remote control in wireless communication with at least one of the trolling motor and the at least one motor pod.

In another aspect, the invention provides a motor pod for a watercraft. The motor pod includes a housing, a motor carried within the housing, a thrust element coupled to the motor for producing thrust, and a mounting arrangement configured to mount the motor pod proximal a transom of a watercraft.

In certain embodiments according to this aspect, the motor pod further comprises a control interface for controlling an operation of the motor. The mounting arrangement may include a mount, and the motor pod linearly and/or rotationally movable relative to the transom via the mount. The motor pod may also include a sensor for determining a heading of the watercraft.

In yet another aspect, the invention provides a method of operating a watercraft. An embodiment of a method according to this aspect includes one of directing the watercraft along a route, or maintaining a bow of the watercraft in a fixed location. The method also includes maintaining an orientation of the watercraft relative to a reference datum using at least one motor pod motor while directing the watercraft along the route or maintaining the bow of the watercraft in a fixed location.

In certain embodiments according to this aspect, the step of directing the watercraft along a route or maintaining the watercraft in a fixed location may include using a trolling motor separate from the at least one motor pod. The method may also include sending control signals to the at least one motor pod using a control interface.

In certain embodiments according to this aspect, the step of maintaining the orientation of the watercraft relative to a reference datum includes maintaining the orientation relative to a course over ground, maintaining the orientation relative to a compass heading, maintaining the orientation relative to at least one of a wind direction and a current direction, maintaining the orientation relative to a shoreline, or maintaining the orientation relative to a depth contour.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, the same illustrate a watercraft and an associated motor pod. The motor pod adds various functionality to the watercraft. In particular, the motor pod, in conjunction with another thrust creating device (e.g. a main outboard motor, a trolling motor, etc.) allows a user to control the orientation of their watercraft on the water. Such orientation control is desirable as it allows an angler to orient and reorient the watercraft quickly to maximize results.

As one example, such orientation control allows the anglers to approach a desirable fishing location more efficiently. The orientation of the watercraft may be controlled such that it is parallel to the shore to provide easier casting towards the shoreline by one or more anglers in the watercraft. As another example, such orientation control allows for holding the watercraft perpendicular to the direction of travel during a slow troll which allows multiple lines to be used off of one side of the watercraft while minimizing the likelihood of the lines tangling. As yet another example, such orientation control allows the user to quickly orient the boat after landing a fish, to make the process of reeling in the fish more efficient.

Such orientation control also provides distinct advantages outside of the context of fishing. For example, controlling the orientation of the watercraft is helpful when docking the watercraft. Controlling the orientation of the watercraft may also be helpful when conducting other activities such as sightseeing, etc.

Figure 1:
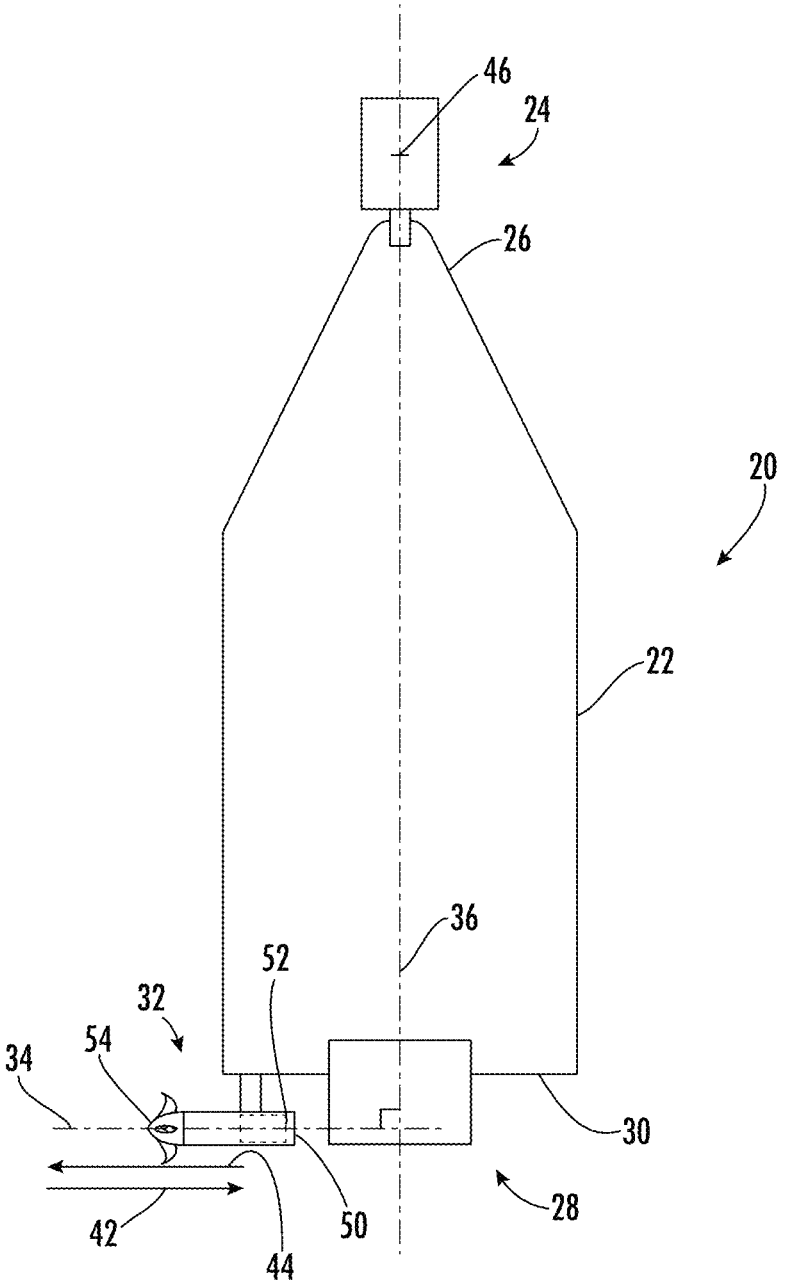
FIG. 1 is a schematic top view of exemplary embodiments of a watercraft and associated motor pod according to the teachings herein.

With particular reference now to FIG. 1, the same illustrates a generally schematic embodiment of a watercraft 20 constructed in accordance with the teachings herein. Watercraft 20 is generally illustrated as a contemporary fishing boat. However, it will be readily recognized that the teachings herein regarding the below discussed motor pod may be readily incorporated into a variety of watercrafts, including but not limited to kayaks and other smaller vessels.

Watercraft 20 includes a hull 22. A trolling motor 24 is mounted proximal the bow 26 of hull 22. A main outboard motor 28 is mounted proximal a transom 30 of hull 22. At least one motor pod 32 is also mounted proximal transom 30. The term "proximal" in the foregoing includes mounted directly or indirectly to the bow or transom, respectively. The term "proximal" also includes being mounted near the bow or transom, respectively, such that the thrust generated by trolling motor 24, main outboard motor 28, or motor pod 32 is generated at a location adjacent the bow or transom, as the case may be. Although a single motor pod is illustrated, it is contemplated that multiple motor pods 32 could be situated about hull 22 to achieve the advantages described herein. As such, descriptions relative to the single motor pod 32 illustrated should be taken to apply equally as well to additional motor pods 32 if such were included.

Motor pod 32 is arranged along a thrust axis 34 that is transverse to a keel axis 36 of hull 22. In the illustrated embodiment, thrust axis 34 is perpendicular to keel axis 36. However, it is envisioned that motor pod 32 may be mounted in any other orientation, including orientations which place thrust axis 34 parallel to keel axis 36. Motor pod 32 is operable to produce thrust in directions 42, 44, and operate alone or in conjunction with trolling motor 24 as well as main outboard motor 28.

Indeed, trolling motor 24 may direct thrust along any direction extending radially from trolling motor axis 46. Such functionality is useful for direction bow 26 in a given direction, or for holding bow 26 at a given location or vicinity. Such functionality, however, may not prevent undesirable movement of transom 30. In particular. Such functionality may not prevent transom 30 from swaying unintentionally due to wind, water currents, or other external forces.

Motor pod 32 is arranged to produce thrust in directions 42, 44 to counteract the aforementioned swaying. Motor pod 32 is also arranged to provide such thrust even where transom 30 is not swaying to allow for controlling the orientation of watercraft 20, regardless of any external forces acting thereupon. As such, it will be recognized that motor pod 32 is thus designed to work alone or in conjunction with trolling motor 24, as well as main outboard motor 28. Indeed, trolling motor 24 may produce a thrust force in one direction, while motor pod 32 produces a thrust force in another direction. Due in part to the locations of trolling motor 24 and motor pod 32, this will cause watercraft 20 to assume a particular and desirable orientation.

Motor pod 32 includes a housing 50 that houses a motor 52. Motor 52 provides an input torque to a thrust element 54 for producing thrust in directions 42, 44. Thrust element 54 may be a propeller configured such that when rotated in one direction by motor 52, it will product thrust in one of directions 42, 44, and when rotated in an opposite direction by motor 52 it will produce the same or similar amount of thrust in the other one of directions 42, 44. Motor 52 may be an electric motor designed to run in forward or reverse, which alleviates the need to mount motor pod 32 in only one direction.

It is also envisioned that motor pod 32 may take on the form of any other thrust producing device capable of providing thrust in a single direction, or in two opposite directions as is currently shown. Motor pod 32 is thus not limited to the motor driven propeller configuration as is shown. Further, it is envisioned that motor pod 32 may be embodied by two separate devices, for producing thrust in opposite directions, respectively. For example, motor pod 32 could include two propellers facing in opposite directions and driven by one motor associated with both propellers, or two motors respectively associated with each propeller. As another example, motor pod 32 could employ a thrust element in the form of an impeller and appropriate structure to enable thrust in two directions, or two impellers directed in opposite directions.

Figure 2:
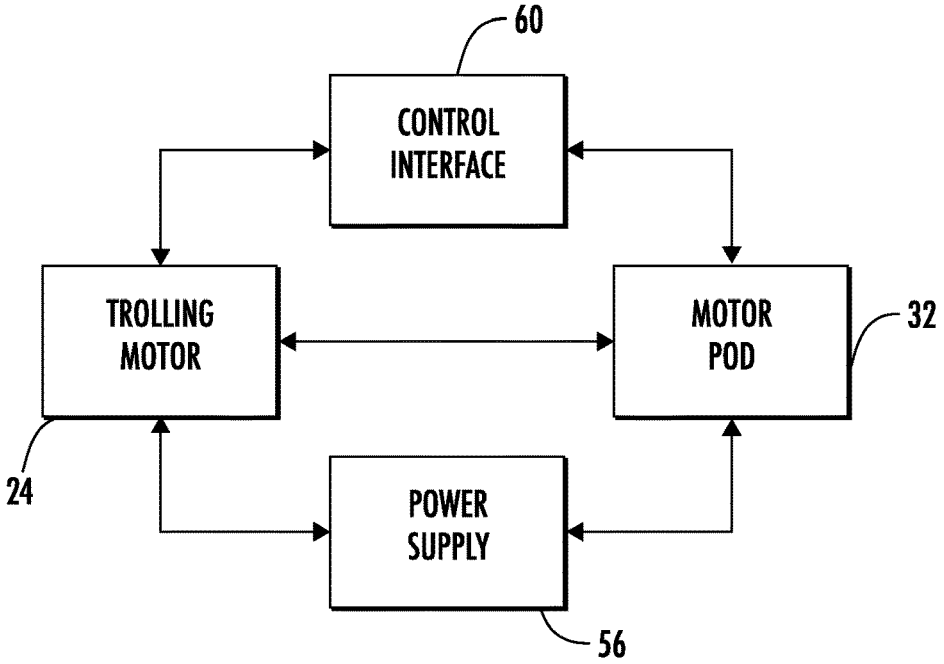
FIG. 2 is a schematic view of the topology of the watercraft of FIG. 1.

Turning now to FIG. 2, the same illustrates an exemplary topology of watercraft 20. Motor pod 32 and trolling motor 32 may be connected to a common power supply 56 such as a battery. Alternatively, motor pod 32 may have its own power supply. Motor pod 32 may also communicate with a control interface 60 for controlling the operation of motor pod 32. Trolling motor 24 may also communicate with such a control interface 60, or include its own control interface which may communicate with control interface 60. Indeed, it is contemplated that motor pod 32 may be controlled and operated in conjunction with trolling motor 24, or may be controlled and operated entirely separate from trolling motor 24.

Further, control interface 60 may itself be integrated entirely or partially into trolling motor 24 or motor pod 32 or both. For example, control interface 60 may be entirely contained within trolling motor 24 or motor pod 32, with a user interface accessible on such devices. Alternatively, control interface 60 may include a controller or other device(s) that is/are contained locally within trolling motor 24 or motor pod 32 or both and communicate(s) with the remainder of control interface 60 located externally from such devices.

As a non-limiting example, control interface 60 may include an internal control system of trolling motor 24 that can communicate via a wired or wireless connection with an internal controller of motor pod 32 to control the operation thereof. Indeed, trolling motor 24 can include its own internal GPS functionality and heading sensors that allow for the collection of compass and position data and the use of this data to direct the operation of trolling motor 24. That same data may also be used for control of motor pod 32 by control interface 60. Such GPS functionality (sensors, antennas, etc.) and heading sensors may be internal to the trolling motor as mentioned above, or mounted about watercraft 20. Alternatively, motor pod 32 may be provided with its own stand-alone GPS functionality and heading sensors so as to collect its own position and heading information independently from other devices on watercraft 20. In such a scenario, it is also conceivable that motor pod 32 could include its own standalone control interface 60 for communicating and controlling the operation of such GPS functionality and heading sensors. In other words, while it is envisioned that motor pod 32 could form part of an integrated system having one or more control interfaces 60 and a trolling motor, it is also conceived that motor pod 32 may be a self-contained system in the sense that it includes its own standalone control interface 60, and its own GPS functionality and/or heading sensor(s), with such GPS functionality and sensors being internal to motor pod 32, or externally mounted about watercraft 20.

It is also conceived that control interface 60 may include or be completely embodied by an external device such as a multi-function display (e.g. a fish finder), or a mobile device such as a mobile phone, or other portable electronic. In such a scenario, such a control interface could communicate via a wired or wireless connection with one or both trolling motor 24 and motor pod 32. With such an external control interface 60, the same would include, or be in communication with, devices that provide, gps functionality, heading and other navigational data.

Control interface 60 is operable to receive and interpret user inputs, and produce corresponding outputs by one or both of trolling motor 24 and motor pod 32 as discussed herein. To this end, control interface 60 can include any software, firmware and hardware necessary to achieve the functionality described herein, and may also include various formats of user input devices. For example, control interface 60 may include a foot pedal of the type typically used to control a trolling motor. Control interface may also include a remote control in wired or wireless communication with the remainder of the system. Such a remote control may be held or otherwise accessible by the user for controlling the operation of one or both of trolling motor 24 and motor pod 32, and may be stand-alone device or may be embodied as an application on an existing device such as a mobile phone.

Control interface 60 is configured to control watercraft orientation at any time and can do so independently of what function trolling motor 24, main outboard motor 28, or other thrusters on watercraft 20 are currently performing. For example, control interface 60 may control motor pod 32 to achieve a desired watercraft 20 orientation while trolling motor 24 is navigating continuous data meaning watercraft is moving and not stationary. Examples of this type of navigation would be following a track, following a depth contour, navigating to a waypoint, etc. Control interface may also control motor pod 32 to achieve a desired watercraft orientation while watercraft 20 is stationary, e.g. while anchored by a traditional anchor, while anchored by a shallow water anchor, or while trolling motor 24 is holding bow 26 in a fixed position, e.g. during virtual anchoring. Control interface may also control motor pod 32 to jog or offset from such a virtual anchoring point.

Control interface may also control motor pod 32 to achieve a desired watercraft orientation while trolling motor 24 is in manual navigation, while watercraft 20 is being propelled by a device other than trolling motor 24, while watercraft 20 is not being propelled by one of its devices at all, e.g. while drifting, while watercraft 20 is being held by a traditional anchor and rope, or shallow water anchoring device.

Figure 3:
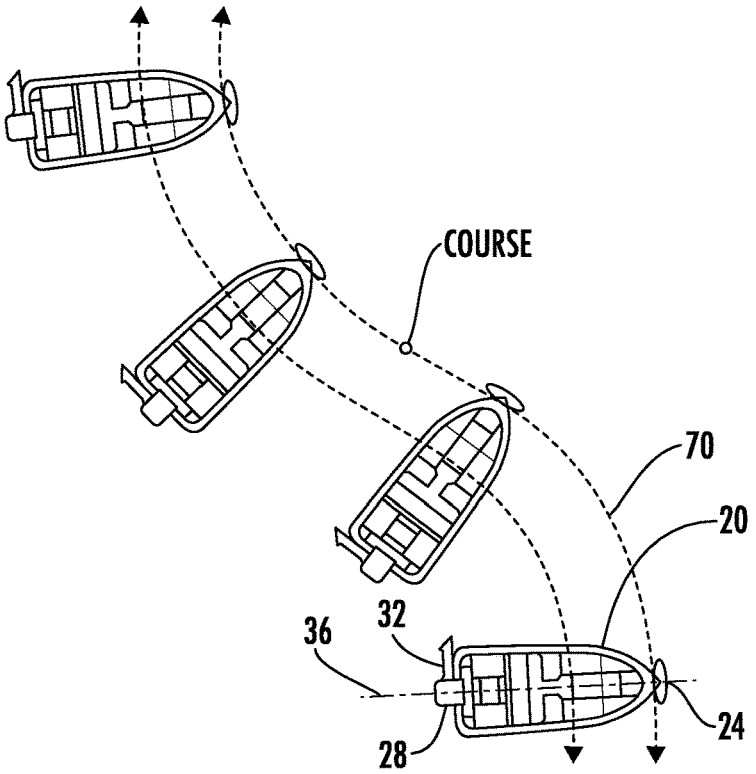
FIG. 3 is a top view of the watercraft and motor pod of FIG. 1, traveling over a course while maintaining an offset course over ground orientation.

It is contemplated that watercraft 20 orientation may be maintained using motor pod 32 relative to course over ground (also referred to as "COG"), or relative to an absolute reference. With particular reference now to FIG. 3, course over ground navigation will be described first. The boat is held in a fixed orientation with respect to course 70 of watercraft 20. As course 70 changes, the orientation of watercraft will change to hold the same orientation of watercraft 20 relative to course 70. As can be seen in the exemplary illustration of FIG. 3, this orientation is such that keel axis 36 is approximately perpendicular to course 70 throughout travel. The foregoing may be employed when following a prescribed route or contour, while manually navigating, or while drifting with the wind or current.

Several options are envisioned for setting this orientation relative to COG. As one example the user can enter the target orientation angular value via control interface 60. A value of 0° could mean that the watercraft orientation is the same as COG. A value of 90° could mean that the watercraft orientation is rotated 90° clockwise with respect to COG. Similarly, a value of 270°, or −90°, may mean the boat orientation is rotated clockwise 270° with respect to the COG. Control interface 60 uses the orientation that watercraft 20 is in (with respect to the COG) when orientation mode is selected and uses that as a "zero" value for orientation. It is also envisioned that the user can then incrementally adjust orientation in either direction.

Figure 4:
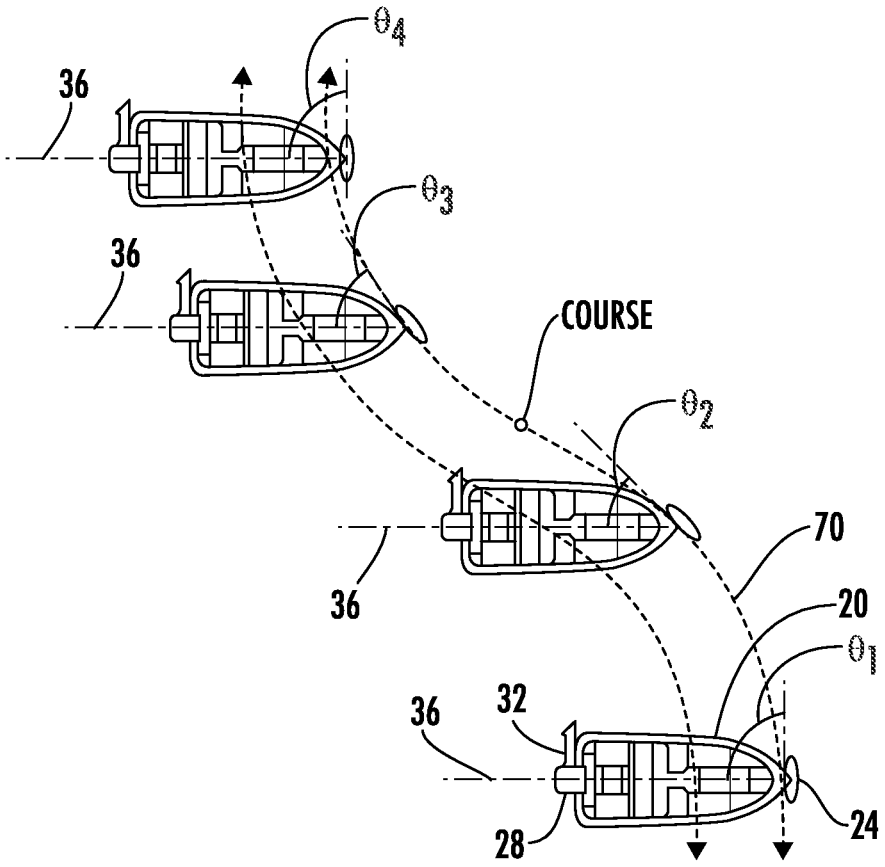
FIG. 4 is a top view of the watercraft and motor pod of FIG. 1, travelling over a course while maintaining an absolute orientation.

Turning now to FIG. 4, the same depicts an example of absolute navigation. In this configuration, motor pod 32 is operable alone or in conjunction with other thrust devices of watercraft 20 to maintain watercraft 20 at a fixed compass orientation regardless of the direction of travel. As may be seen in FIG. 4, keel axis 36 may assume different angles $\theta_1$-$\theta_4$ as watercraft moves along course 70. In this configuration, the user may use control interface 60 to select an absolute heading value either numerically or using the North-South-East-West scale. Examples would be any compass heading from 0°-359° or north, west, northwest, north-northwest, north, east, northeast, etc. As was the case with COG orientation discussed above relative to FIG. 3, the user incrementally adjust this orientation setting as needed.

In addition to the COG and absolute orientation examples described above, it is also envisioned that orientation may be relative to other factors such as current or wind direction. Indeed, control interface 60 may collect current or wind information, or receive such current and wind information from other devices on watercraft 20 (e.g. a fish finder) and maintain an orientation relative to the same.

Figure 5:
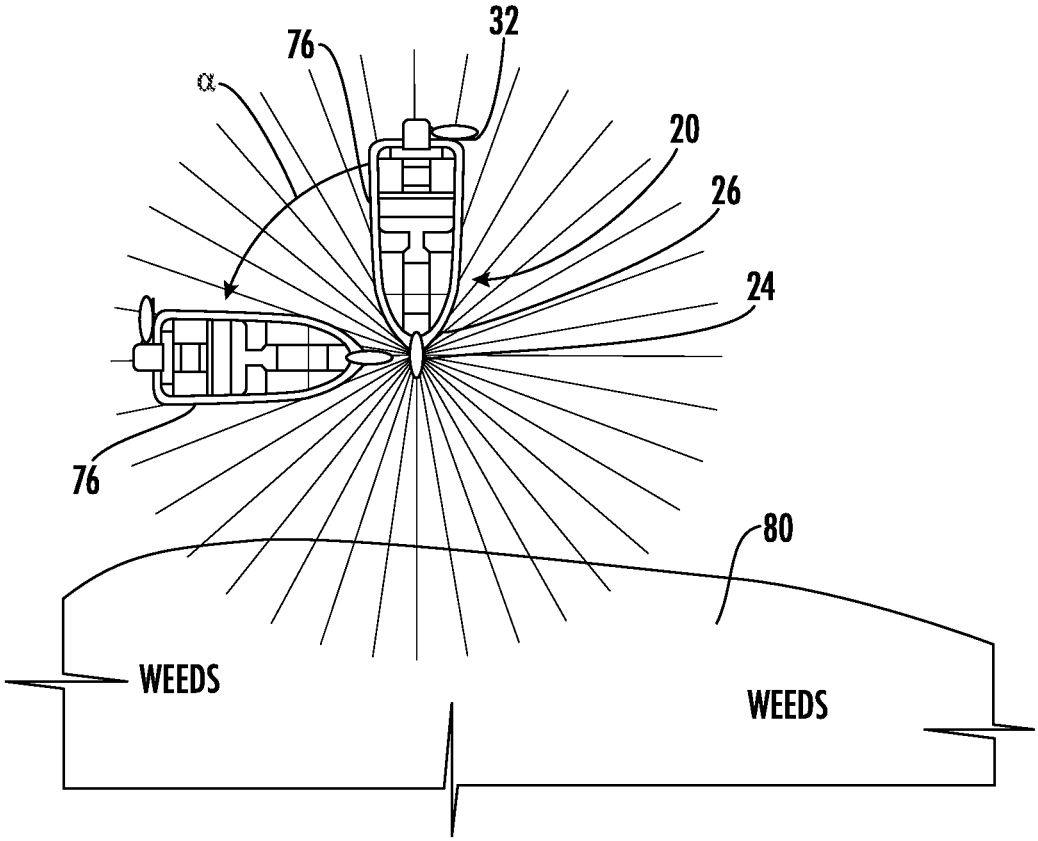
FIG. 5 is a top view of the watercraft and motor pod of FIG. 1, undergoing an angular offset from an anchored position.

It is also envisioned that motor pod 32 may be used to reorient watercraft 20 when it is stationary. An example of the foregoing is illustrated at FIG. 5. In this embodiment, watercraft 20 is stationary and anchored at its bow 26 (by a traditional anchor, a shallow water anchor, or virtually using trolling motor 24) such that bow 26 is pointing towards a weed bed 80. It may be desirable, for non-limiting example, to fish weed bed 80, and it may be desirable to cast off of a side 76 of watercraft 20 to do so. A user, for example by using control interface 60, may input a desired angular offset value a to cause motor pod 32 to generate thrust in direction 44 (FIG. 1). This will cause watercraft 20 to rotate about the aforementioned anchor point such that side 76 now faces weed bed 80 as shown.

It is also envisioned that motor pod 32 may assist docking operations. Indeed, motor pod 32 may work in conjunction with trolling motor 24 to maintain an orientation of watercraft 20 parallel to a dock, while moving watercraft 20 into proximity of the dock. This operation may be a fully automated docking mode in control interface 60.

Figure 6:
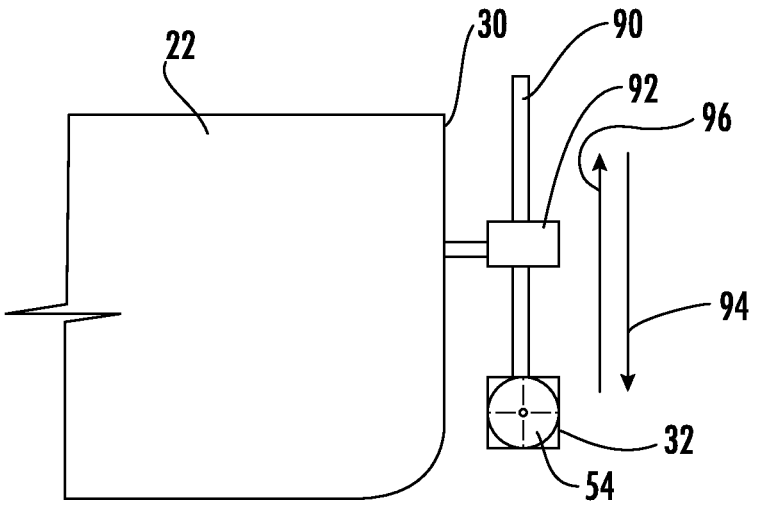
FIG. 6 is a partial side view of the watercraft and motor pod of FIG. 1.
Figure 7:
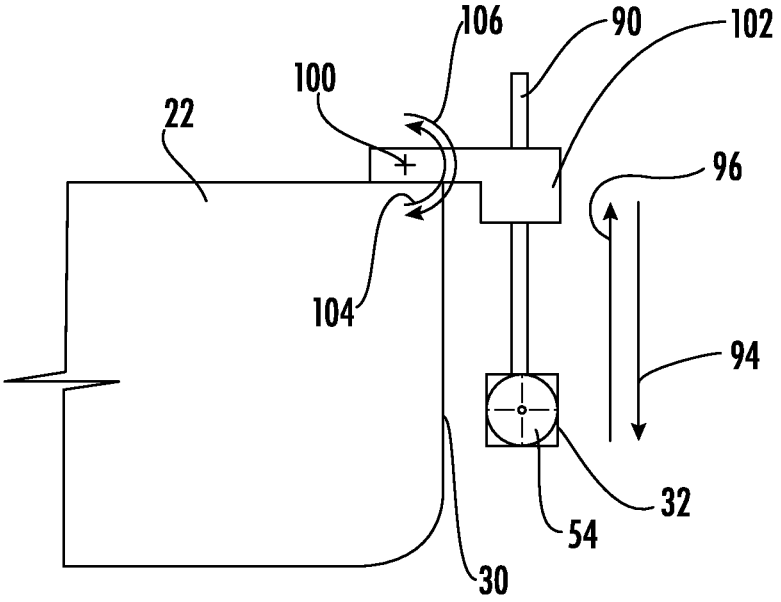
FIG. 7 is another partial side view of the watercraft and motor pod of FIG. 1.

Turning now to FIGS. 6-7, it is contemplated that motor pod 32 may be mounted proximal transom 30 via a variety of configurations, some of which can allow for adjustment of the positioning of motor pod 32. With particular reference to FIG. 6, motor pod 32 may be mounted to a mounting rod 90 that is received by a mounting collar 92 mounted to transom 30. Mounting rod 90 may be slidable relative to collar 92 in directions 94, 96 to govern a distances of motor pod 32 from an upper-most edge of transom 30. Collar 92 may include a set screw or other device allowing the user to lock rod 90 at a given position within collar 92.

Another example of such a mounting configuration is shown at FIG. 7. Similar to the configuration shown in FIG. 6, motor pod 32 is mounted to rod 90 and is slidable within a rotatable collar 102 in directions 94, 96. This rotatable collar 102 is also rotatable about an axis 100 in directions 104, 106.

It is also contemplated that the mounting of motor pod 32 may be such that it may be unlocked so as to be rotatable to direct the thrust provided thereby. In this way, motor pod 32 would function similar to trolling motor 24. It is contemplated that in such a configuration, motor pod 32 may be manually steered, e.g. via a handle connected to rod 90, may be steered via other steering devices of watercraft 20 such as the steering wheel thereof using an appropriate linkage, or may have a stand-alone electric steering module similar to many contemporary trolling motors. In this way motor pod 32 may be used as the primary prolusion device of watercraft 20 alone or in conjunction with trolling motor 24, in areas of low wake or areas which forbid gasoline engines. With such a configuration, a motor pod 32 assist function is also contemplated, where motor pod 32 orients itself in the same direction as trolling motor 24 to assist in propelling watercraft 20 forward.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An operating system for a watercraft having a hull defining a keel axis, a bow, and a transom of the watercraft, comprising: a trolling motor mounted proximal to the bow of the watercraft; at least one motor pod mounted proximal the transom of the watercraft, the at least one motor pod arranged to provide thrust in a first direction and a second direction along a thrust axis, the thrust axis arranged transverse to the keel axis; and a control interface for controlling the trolling motor for directing the watercraft along a course over ground having at least one change in direction, and for controlling the at least one motor pod for maintaining an orientation of the watercraft relative to the course over ground such that as the course over ground changes direction, the at least one motor pod will change the orientation of the watercraft to hold a fixed target orientation angular value of the watercraft relative to the course over ground; and where the fixed target orientation angular value includes orientations where the keel axis is not aligned with the course over ground.

2. The watercraft of claim 1, wherein the control interface comprises a fish finder.

3. A method of operating a watercraft, comprising: directing the watercraft along a route having a changing direction; maintaining a fixed target orientation angular value of the watercraft relative to the changing direction of the route using at least one motor pod while directing the watercraft along the route, where the fixed target orientation angular value includes orientations where the keel axis is not aligned with the changing direction of the route.

4. The method of claim 3, wherein the step of directing the watercraft along a route includes using a trolling motor separate from the at least one motor pod.

5. The method of claim 3, further comprising sending control signals to the at least one motor pod using a control interface.

6. The method of claim 3, wherein the step of maintaining the fixed target orientation angular value of the watercraft relative to the changing direction of the route includes maintaining the fixed target orientation angular value relative to a course over ground.

7. The method of claim 3, wherein the step of maintaining the fixed target orientation angular value of the watercraft relative to the changing direction of the route includes maintaining the fixed target orientation angular value relative to a shoreline having the changing direction.

8. The method of claim 3, wherein the step of maintaining the fixed target orientation angular value of the watercraft relative to the changing direction of the route includes maintaining the fixed target orientation angular value relative to a depth contour line having the changing direction.

9. The method of claim 3, wherein the step of maintaining the fixed target orientation angular value of the watercraft relative to the changing direction of the route includes maintaining the fixed target orientation angular value perpendicular to a direction of travel along the changing direction of the route.

10. The method of claim 3, wherein the step of maintaining the fixed target orientation angular value of the watercraft relative to the changing direction of the route includes the step of changing control angle relative to the route to change the fixed target orientation angular value of the watercraft relative to the changing direction of the route.

11. The method of claim 10, wherein the step of changing the control angle relative to the route to change the fixed target orientation angular value of the watercraft comprises the step of using the at least one motor pod to provide thrust in a first direction perpendicular to a keel axis of the watercraft to rotate the orientation of the watercraft to align with the control angle from the step of changing.

12. The method of claim 11, wherein the step of changing the control angle relative to the route to change the fixed target orientation angular value of the watercraft further comprises the step of using the at least one motor pod to provide thrust in a second direction opposite the first direction to rotate the orientation of the watercraft to maintain alignment with the control angle from the step of changing.

13. The method of claim 3, wherein the step of maintaining the fixed target orientation angular value of the watercraft relative to the changing direction of the route using at least one motor pod comprises at least one of the steps of using a first motor pod to provide thrust in a first direction perpendicular to a keel axis of the watercraft to rotate the orientation of the watercraft to align with the changing direction of the route, and using a second motor pod to provide thrust in a second direction opposite the first direction to rotate the orientation of the watercraft to align with the changing direction of the route.

14. The method of claim 3, wherein the step of maintaining the fixed target orientation angular value of the watercraft relative to the changing direction of the route using at least one motor pod comprises the step of using a single motor pod to provide thrust in a first direction perpendicular to a keel axis of the watercraft to rotate the orientation of the watercraft in a first angular direction and using the single motor pod to provide thrust in a second direction opposite the first direction to rotate the orientation of the watercraft in a second angular direction.

15. The method of claim 3, wherein the step of maintaining the fixed target orientation angular value of the watercraft relative to the changing direction of the route includes maintaining the orientation relative to a weed bed having the changing direction.

16. A method of operating a watercraft, comprising:

providing a trolling motor in proximity to a bow of the watercraft;

providing a motor pod in proximity to a transom of the watercraft;

controlling the trolling motor to direct the watercraft along a route having a changing direction; and controlling the motor pod during the step of controlling the trolling motor to maintain a fixed target orientation angular value of the watercraft relative to the changing direction of the route, where the fixed target orientation angular value includes orientations where the keel axis is not aligned with the changing direction of the route.

17. The method of claim 16, wherein the step of controlling the trolling motor comprises the step of rotating the trolling motor to provide thrust radially relative to the bow in order to position the bow along the route, and wherein the step of controlling the motor pod comprises the step of providing thrust perpendicularly to the transom.

* * * * *